US006941845B2

(12) United States Patent
Hsien

(10) Patent No.: US 6,941,845 B2
(45) Date of Patent: Sep. 13, 2005

(54) HAND TOOL HAVING BENDABLE HOLDING PORTION

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/730,724

(22) Filed: Dec. 5, 2003

(65) Prior Publication Data

US 2005/0120837 A1 Jun. 9, 2005

(51) Int. Cl.[7] ..... B25B 7/00
(52) U.S. Cl. ..... 81/417; 81/427
(58) Field of Search ..... 81/415, 417, 427

(56) References Cited

U.S. PATENT DOCUMENTS 6,014,917 A * 1/2000 Bally et al. ..... 81/355
6,145,417 A * 11/2000 Bates et al. ..... 81/387
6,178,855 B1 * 1/2001 Bally et al. ..... 81/355
6,263,770 B1 * 7/2001 Gomas et al. ..... 81/427
6,378,404 B1 * 4/2002 Bally et al. ..... 81/355
6,467,380 B1 * 10/2002 Azkona ..... 81/413

FOREIGN PATENT DOCUMENTS

GB 2369794 A * 6/2002 ..... B25B 7/18

* cited by examiner

*Primary Examiner*—David B. Thomas

(57) ABSTRACT

A hand tool includes a head portion having two jaw portions, a handle portion pivotally mounted on the head portion and having two holding grips, a mounting tube mounted on a first one of the two holding grips, a push rod mounted on a second one of the two holding grips and slidably mounted in the mounting tube, and an elastic member mounted in the mounting tube and urged between the mounting tube and the push rod. Thus, the two holding grips of the handle portion have the same bent angle, thereby facilitating the user adjusting the included angle between the head portion and the handle portion.

6 Claims, 7 Drawing Sheets

HAND TOOL HAVING BENDABLE HOLDING PORTION

BACKGROUND OF THE INVENTION

1. Field of the Invention

The present invention relates to a hand tool, such as a pair of pliers or the like, and more particularly to a hand tool, wherein the two holding grips of the handle portion have the same bent angle, thereby facilitating the user adjusting the included angle between the head portion and the handle portion.

2. Description of the Related Art

A conventional hand tool 50, such as a pair of pliers in accordance with the prior art shown in FIGS. 7 and 8 comprises a head portion 51, and a handle portion 54 pivotally mounted on the head portion 51. The head portion 51 has two jaw portions 52 pivotally connected with each other. The handle portion 54 has two holding grips 56 each having an end pivotally mounted on an end of a respective one of the two jaw portions 52 of the head portion 51. Thus, the handle portion 54 can be bent relative to the head portion 51 so as to adjust the included angle between the handle portion 54 and the head portion 51.

However, the two holding grips 56 of the handle portion 54 cannot be moved and bent relative to the two jaw portions 52 of the head portion 51 synchronously, so that the included angle between the handle portion 54 and the head portion 51 cannot be adjusted easily and rapidly. In addition, the bent angles of the two holding grips 56 of the handle portion 54 are adjusted independently, so that the two holding grips 56 of the handle portion 54 are not aligned with each other easily, thereby decreasing the driving force of the handle portion 54.

SUMMARY OF THE INVENTION

The primary objective of the present invention is to provide a hand tool, wherein the two holding grips of the handle portion have the same bent angle, thereby facilitating the user adjusting the included angle between the head portion and the handle portion.

Another objective of the present invention is to provide a hand tool, wherein the elastic member is hidden in the mounting tube, so that the elastic member does not directly contact the air to prevent the elastic member from being rusted due to contacting the air.

A further objective of the present invention is to provide a hand tool, wherein by provision of the mounting tube and the push rod, the two holding grips of the handle portion can be pivoted relative to the two jaw portions of the head portion synchronously, so that the included angle between the handle portion and the head portion can be adjusted easily and rapidly.

A further objective of the present invention is to provide a hand tool, wherein when the user unintentionally touches one of the two holding grips of the handle portion, the two holding grips of the handle portion have the same bent angle by provision of the mounting tube and the push rod, so that the driving force of the handle portion will not be changed.

In accordance with the present invention, there is provided a hand tool, comprising:

- a head portion having two jaw portions pivotally connected with each other by a pivot pin;
- a handle portion pivotally mounted on the head portion and having two holding grips each having a first end pivotally mounted on an end of a respective one of the two jaw portions of the head portion by a positioning pin and a second end formed with a counterbore;
- a mounting tube mounted on the second end of a first one of the two holding grips of the handle portion;
- a push rod mounted on the second end of a second one of the two holding grips of the handle portion and slidably mounted in the mounting tube; and
- an elastic member mounted in the mounting tube and urged between the mounting tube and the push rod.

Further benefits and advantages of the present invention will become apparent after a careful reading of the detailed description with appropriate reference to the accompanying drawings.

DETAILED DESCRIPTION OF THE INVENTION

Figure 1:
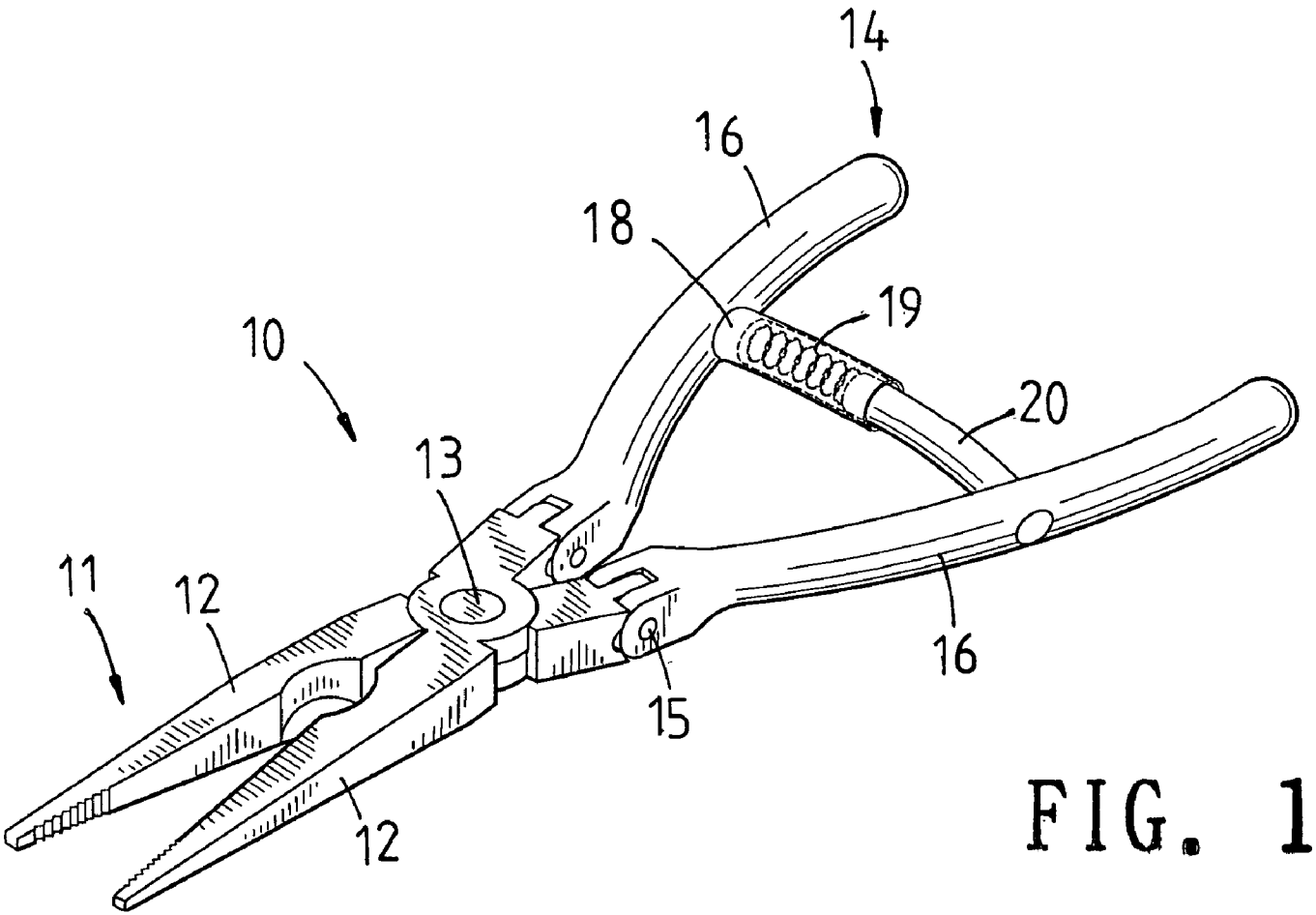
FIG. 1 is a perspective view of a hand tool in accordance with the preferred embodiment of the present invention.
Figure 2:
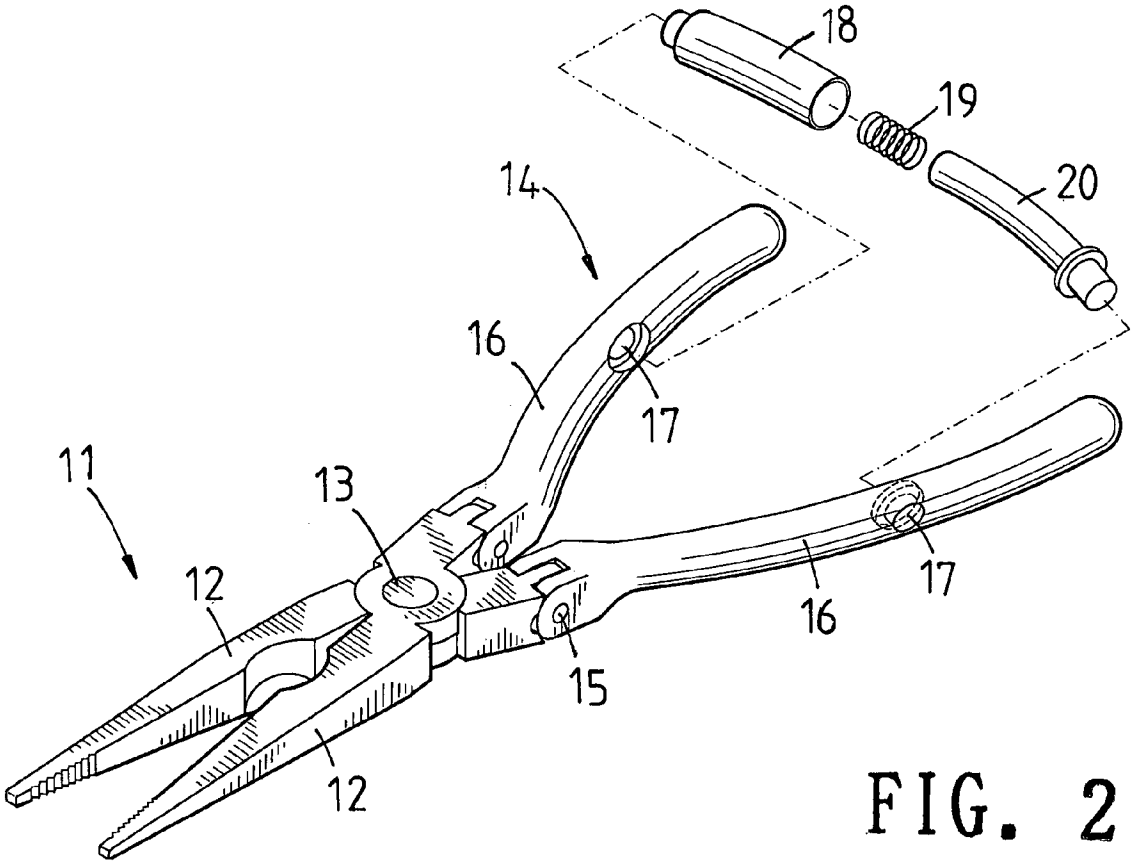
FIG. 2 is an exploded perspective view of the hand tool as shown in FIG. 1.
Figure 3:
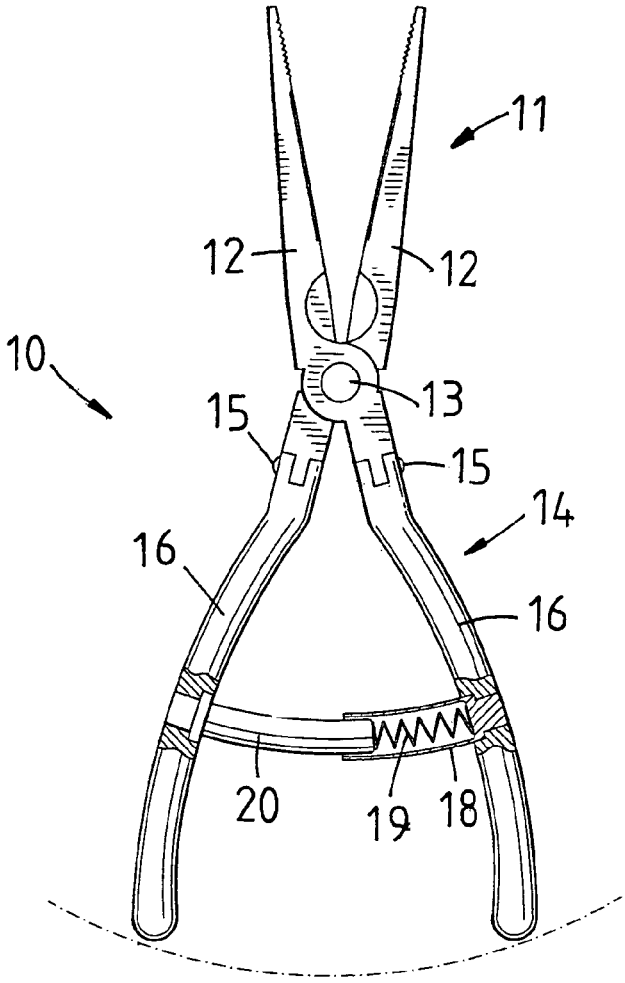
FIG. 3 is a top plan partially cross-sectional view of the hand tool as shown in FIG. 1.

Referring to the drawings and initially to FIGS. 1–4, a hand tool 10, such as a pair of pliers or the like, in accordance with the preferred embodiment of the present invention comprises a head portion 11, and a handle portion 14 pivotally mounted on the head portion 11.

The head portion 11 has two jaw portions 12 pivotally connected with each other by a pivot pin 13.

The handle portion 14 has two holding grips 16 each having a first end pivotally mounted on an end of a respective one of the two jaw portions 12 of the head portion 11 by a positioning pin 15. Thus, the handle portion 14 is pivoted relative to the head portion 11 to adjust the included angle between the handle portion 14 and the head portion 11. Each of the two holding grips 16 of the handle portion 14 has a second end formed with a counterbore 17.

The hand tool 10 further comprises an arc-shaped mounting tube 18 mounted on the second end of a first one of the two holding grips 16 of the handle portion 14, an arc-shaped push rod 20 mounted on the second end of a second one of the two holding grips 16 of the handle portion 14 and slidably mounted in the mounting tube 18, and an elastic member 19 mounted in the mounting tube 18 and urged between the mounting tube 18 and the push rod 20.

Preferably, the mounting tube 18 has an end inserted into the counterbore 17 of the first one of the two holding grips 16 of the handle portion 14, and the push rod 20 has an end inserted into the counterbore 17 of the second one of the two holding grips 16 of the handle portion 14.

Figure 4:
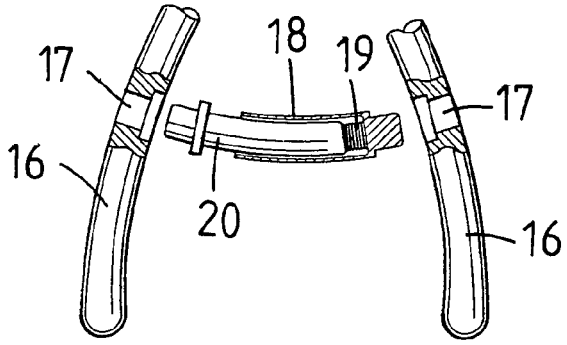
FIG. 4 is a partially cut-away exploded view of the hand tool as shown in FIG. 3.

As shown in FIG. 4, when not in use, the elastic member 19 exerts an elastic force on the mounting tube 18 and the push rod 20, so that the mounting tube 18 and the push rod

20 are pushed to move outward relative each other to open the two jaw portions 12 of the head portion 11 for use.

Figure 5:
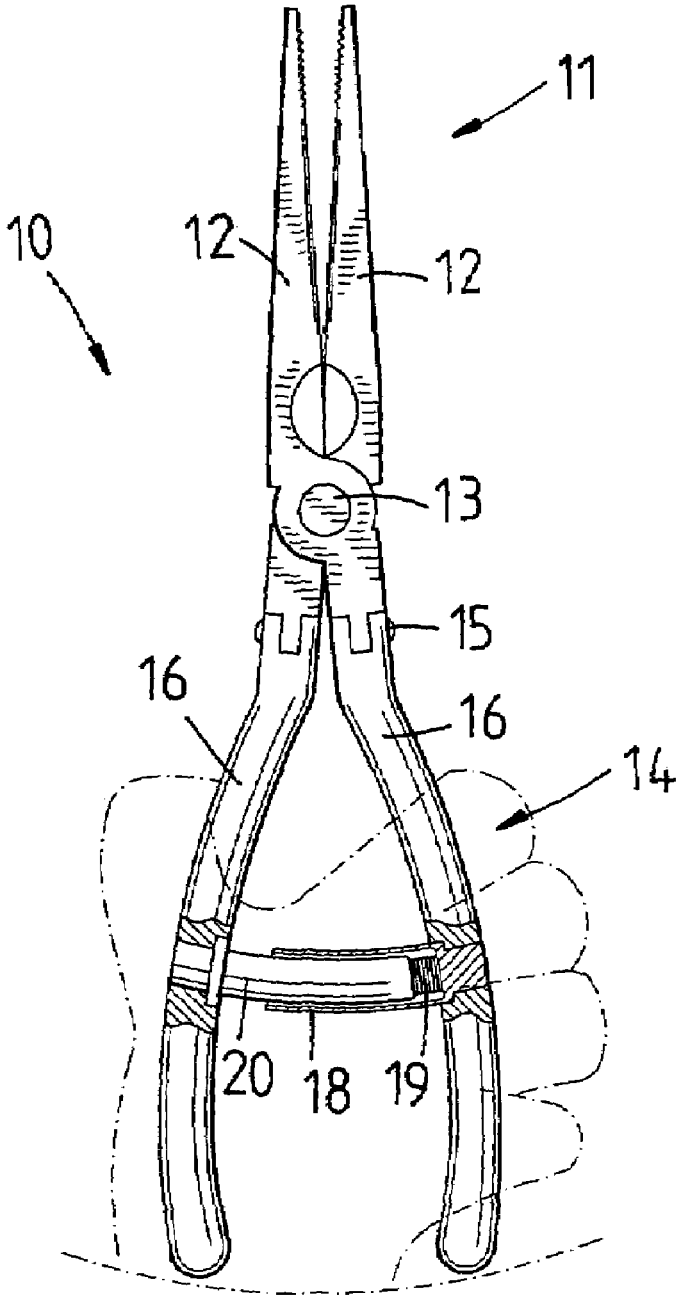
FIG. 5 is a schematic operational view of the hand tool as shown in FIG. 3 in use.

As shown in FIG. 5, when in use, a user's one hand exerts a force on the two holding grips 16 of the handle portion 14 to overcome the elastic force of the elastic member 19, so that the mounting tube 18 and the push rod 20 are pushed to move toward each other to compress the elastic member 19 so as to close the two jaw portions 12 of the head portion 11 to clamp a workpiece (not shown).

Figure 6:
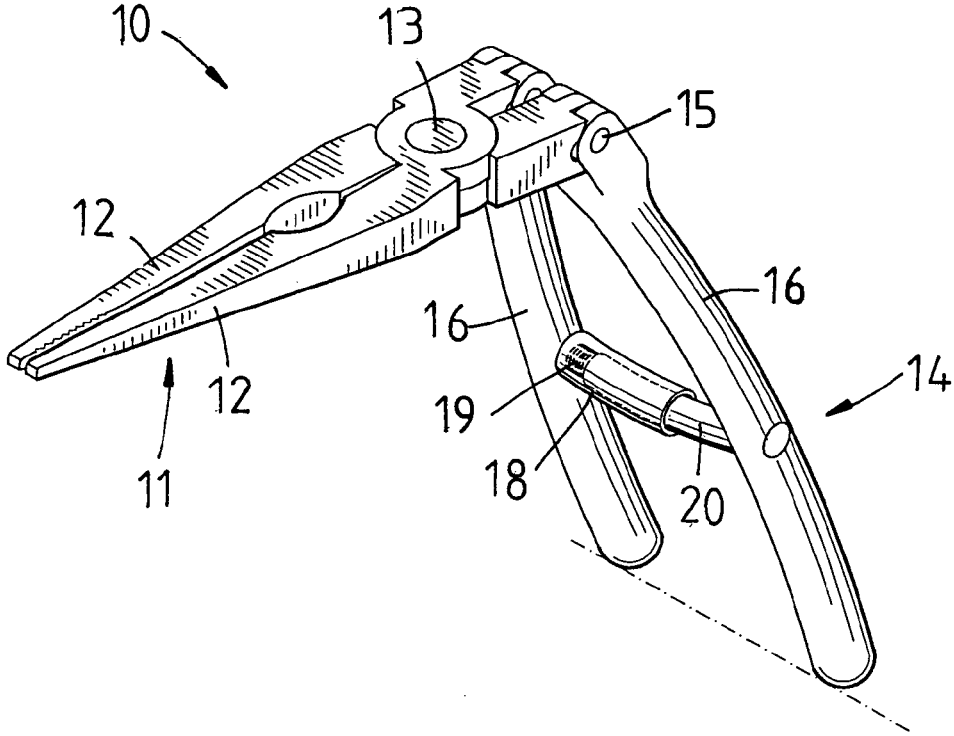
FIG. 6 is a schematic operational view of the hand tool as shown in FIG. 1 in use.
Figure 7:
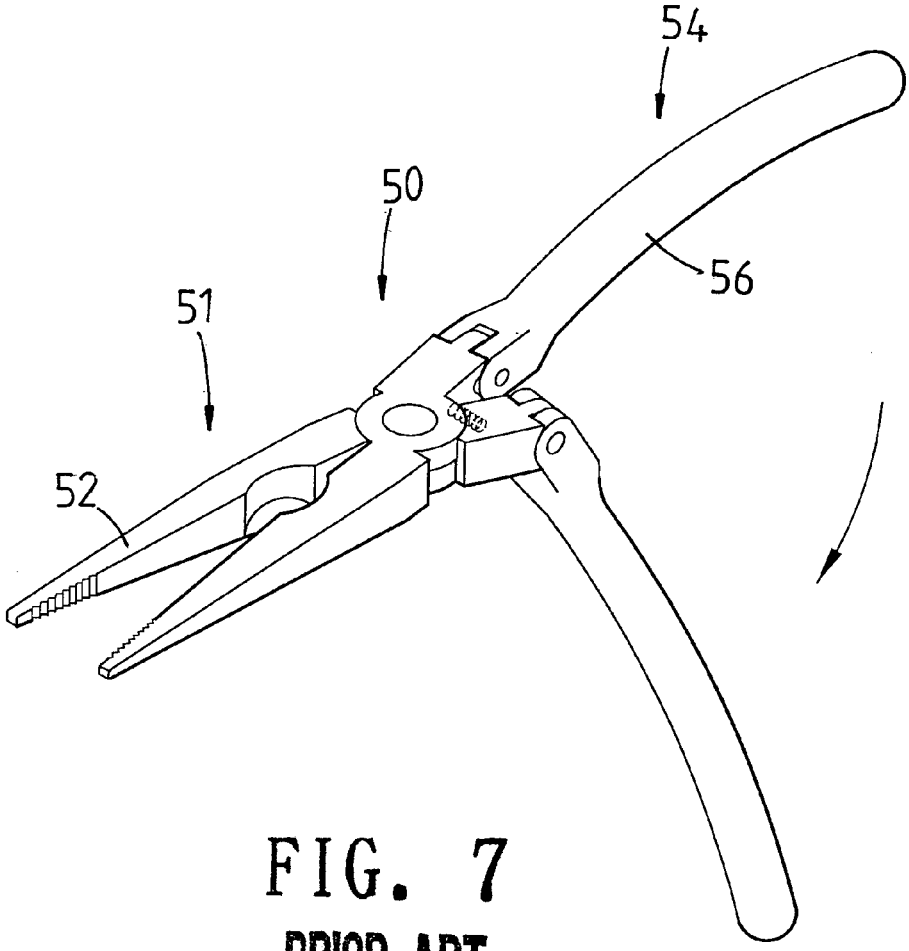
FIG. 7 PRIOR ART
FIG. 7 is a perspective view of a conventional hand tool in accordance with the prior art.
Figure 8:
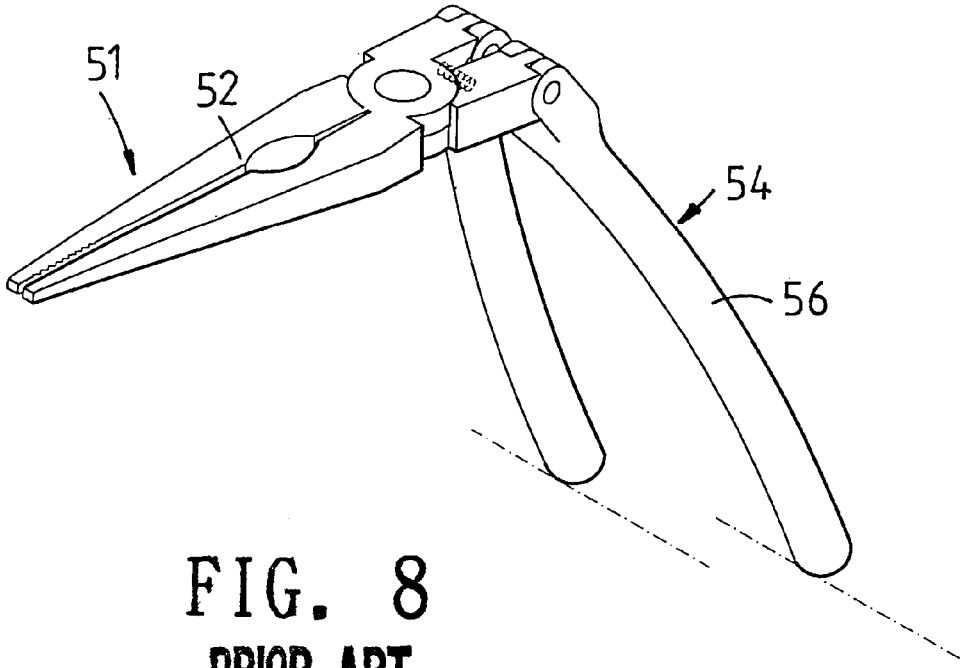
FIG. 8 PRIOR ART
FIG. 8 is a schematic operational view of the conventional hand tool as shown in FIG. 7.

As shown in FIG. 6, the mounting tube 18 mounted on one of the two holding grips 16 is combined with the push rod 20 mounted on the other one of the two holding grips 16, so that the two holding grips 16 of the handle portion 14 can be moved synchronously. Thus, the two holding grips 16 of the handle portion 14 can be pivoted relative to the two jaw portions 12 of the head portion 11 synchronously.

Accordingly, the elastic member 19 is hidden in the mounting tube 18, so that the elastic member 19 does not directly contact the air to prevent the elastic member 19 from being rusted due to contacting the air.

In addition, by provision of the mounting tube 18 and the push rod 20, the two holding grips 16 of the handle portion 14 can be pivoted relative to the two jaw portions 12 of the head portion 11 synchronously, so that the included angle between the handle portion 14 and the head portion 11 can be adjusted easily and rapidly.

Further, the two holding grips 16 of the handle portion 14 have the same bent angle by provision of the mounting tube 18 and the push rod 20, thereby enhancing the driving force of the handle portion 14, so that the two jaw portions 12 of the head portion 11 can be used to clamp the workpiece rigidly and stably.

Further, when the user unintentionally touches one of the two holding grips 16 of the handle portion 14, the two holding grips 16 of the handle portion 14 have the same bent angle by provision of the mounting tube 18 and the push rod 20, so that the driving force of the handle portion 14 will not be changed.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hand tool, comprising:

a head portion having two jaw portions pivotally connected with each other by a pivot pin;

a handle portion pivotally mounted on the head portion and having two holding grips each having a first end pivotally mounted on an end of a respective one of the two jaw portions of the head portion by a positioning pin and a second end formed with a counterbore;

a mounting tube mounted in the counterbore of the second end of a first one of the two holding grips of the handle portion;

a push rod mounted in the counterbore of the second end of a second one of the two holding grips of the handle portion and slidably mounted in the mounting tube; and an elastic member mounted in the mounting tube and urged between the mounting tube and the push rod.

2. The hand tool in accordance with claim 1, wherein the mounting tube is substantially arc-shaped.

3. The hand tool in accordance with claim 1, wherein the push rod is substantially arc-shaped.

4. The hand tool in accordance with claim 1, wherein the mounting tube has an outward protruding stepwise end inserted into and closely fitted in the counterbore of the first one of the two holding grips of the handle portion.

5. The hand tool in accordance with claim 1, wherein the push rod has an outward protruding stepwise end inserted into and closely fitted in the counterbore of the second one of the two holding grips of the handle portion.

6. The hand tool in accordance with claim 1, wherein the two holding grips of the handle portion are moved and pivoted relative to the head portion synchronously.

* * * * *